United States Patent [19]

Hodr et al.

[11] 4,194,537

[45] Mar. 25, 1980

[54] ARRANGEMENT FOR GUIDING A WEFT THREAD END UNDER TENSION TOWARD A FABRIC FELL IN TRAVELLING-WAVE LOOMS

[75] Inventors: Miloslav Hodr; Josef Holub, both of Usti nad Orlici; Jiri Stefek, Zamberk, all of Czechoslovakia

[73] Assignee: Vyzkumny ustav bavlnarsky, Usti nad Orlici, Czechoslovakia

[21] Appl. No.: 729,203

[22] Filed: Oct. 4, 1976

[51] Int. Cl.[2] ..... D03D 49/70

[52] U.S. Cl. ..... 139/194; 139/302; 139/450

[58] Field of Search ..... 139/429, 436, 450, 194, 139/302, 303

[56] References Cited

U.S. PATENT DOCUMENTS

| | | | |
|---|---|---|---|
| 2,519,274 | 8/1950 | Moessinger | 139/194 |
| 2,602,472 | 7/1952 | Pfarrwaller | 139/194 |
| 3,792,723 | 2/1974 | Titou | 139/194 |
| 3,845,790 | 11/1974 | Filter et al. | 139/194 |
| 3,851,679 | 12/1974 | Titou et al. | 139/194 |
| 3,862,647 | 1/1975 | Holub et al. | 139/436 |
| 3,908,710 | 9/1975 | Van Mallekom | 139/194 |

*Primary Examiner*—Henry Jaudon

[57] ABSTRACT

An arrangement for tensioning the end of an inserted weft for beat-up of the weft into a fell by a rotary reed is described. An elongated weft-gripping mechanism is movable forwardly opposite the direction of movement of the portion of the reed which engages the weft being inserted along an axis oblique to the rotary reed into a frontmost position where it engages a weft carried by each of a succession of weft inserters as soon as the inserter has moved past the end of the reed into which the weft has just been inserted. A pair of jaws on the outer end of the gripping mechanism then close to grip the engaged weft and to move it rearwardly into a securing position between a thrust plate and a toothed, weft-guiding disc coaxial with the rotary reed. After the weft is secured, the jaws of the gripping means open and the gripping mechanism is moved forwardly again to grip the next weft.

6 Claims, 9 Drawing Figures

ARRANGEMENT FOR GUIDING A WEFT THREAD END UNDER TENSION TOWARD A FABRIC FELL IN TRAVELLING-WAVE LOOMS

BACKGROUND OF THE INVENTION

The principle of weaving in travelling wave shedding consists in that the loom is equipped with a plurality of weft inserters which are conveyed one after the other in the weaving process through a weaving zone in which they insert metered weft thread lengths into travelling sheds. Having left the weaving zone, the inserters return along an endless path back to the opposite fabric selvage where they are refilled by spooling units with fresh wefts for the next weaving cycle. The operation of such looms requires that the trailing end of the picked weft length be gripped and displaced to the fabric fell where it is to be held until interlaced into the fabric.

The invention relates to travelling-wave looms having a rotary reed for beating up a weft thread, introduced therein by each of a plurality of weft inserters, moving along an endless path past the reed into a fabric fell while the weft end is held tensioned in a space between a thrust plate and a toothed disc supported coaxial with the rotary reed.

In existing arrangements of this type, a stationary projection associated with the thrust plate helps to guide the weft thread from the inserter to the rotary reed. Such stationary projection must be positioned away from the path of movement of the weft inserter to avoid interference therewith. As a result, during the movement of the weft inserter away from the reed preparatory to the beat-up operation, severence of the weft thread from the inserter must be preceeded by a rotation of a guiding tooth on the disc to an appropriate location opposite the thrust plate in order to provide the required beat-up tension on the weft end. The extra length of weft thread which must be withdrawn from the inserter during this portion of the weft inserter movement represents waste length which has to be cut off the fabric selvedge after the beat-up operation.

SUMMARY OF THE INVENTION

Such disadvantage is overcome by the weft end tensioning arrangement of the present invention, which is adapted to operate with travelling-wave looms of the above type. In an illustrative embodiment, the loom is further provided with an elongated weft-gripping mechanism which is reciprocable obliquely to the rotary reed axis between front (FIG. 1) and rear (FIG. 5) positions. In the front position, a pair of closable jaws at the outer end of the gripping mechanism engage and grip a weft carried by the inserter, whereby during the rearward movement of the gripping mechanism the weft is secured between the thrust plate and the outer surface of the toothed disc.

The reciprocation of the weft gripping means is so synchronized with the movement of the weft inserters that as soon as the inserter has moved beyond the rear end of the reed, the jaws at the front end of the gripping means reach their front position to engage the weft carried by the inserter.

After the jaws have gripped the weft, the gripping means is moved rearwardly to secure the gripped weft in the space between the thrust plate and the toothed disc. The jaws are then opened until the gripping means is again moved into its frontmost position following the movement of the next inserter past the rear end of the reed.

With such arrangement, the necessity of maintaining a surplus length of weft end length on the inserter during its movement past the reed is completely obviated, since the jaws of the gripping means can engage the weft end immediately after the inserter has cleared the reed. Moreover, since the jaws of the gripping means remain closed until the weft has been positively transferred to the space between the thrust plate and the disc, any undesired slackening of the weft between severence and beat-up is avoided.

BRIEF DESCRIPTION OF THE DRAWING

The invention is further set forth in the following detailed description taken in conjunction with the appended drawing, in which:

FIG. 6 is a side view of the weft gripping means with opened jaws during the movement from the rear to the front position.

DETAILED DESCRIPTION

Figure 1:
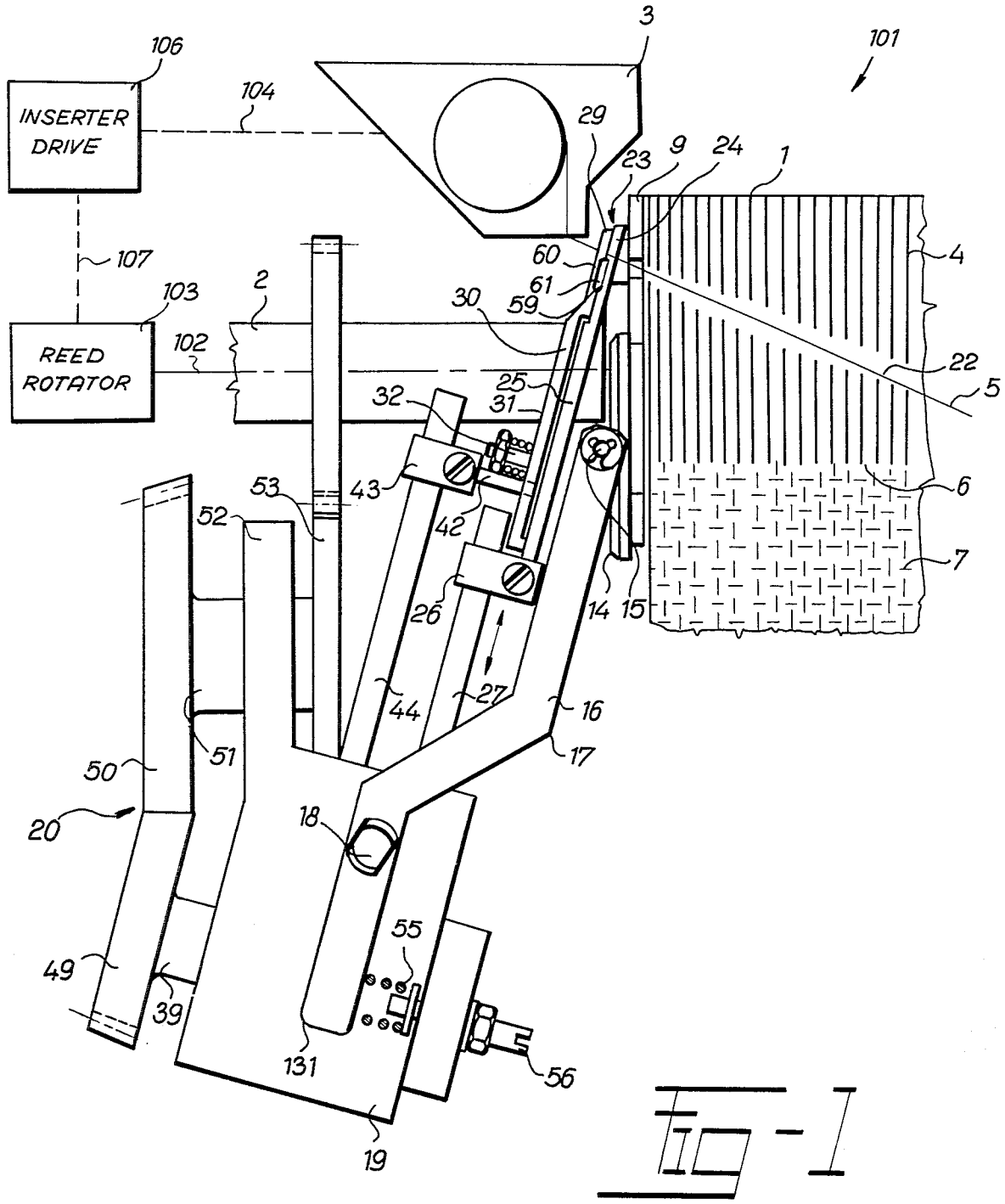
FIG. 1 is an elevation view partly in schematic form, of the weft insertion and beat-up portion of a travelling-wave loom having a reciprocating weft-gripping mechanism constructed in accordance with the invention and shown in its frontmost position.
Figure 2:
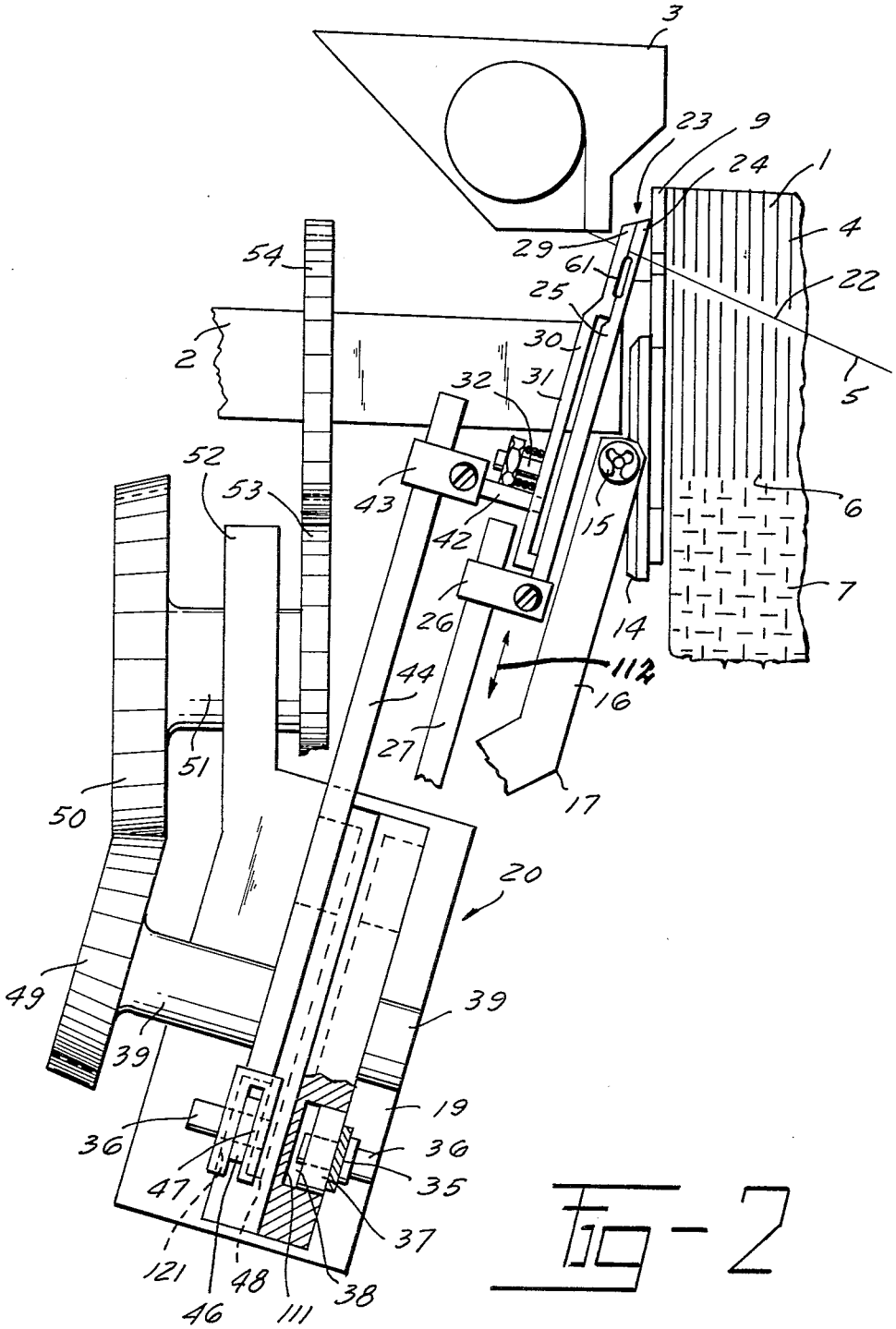
FIG. 2 is a view similar to FIG. 1 but illustrating further details of an eccentric drive for the reciprocating portion of FIG. 1.
Figure 3:
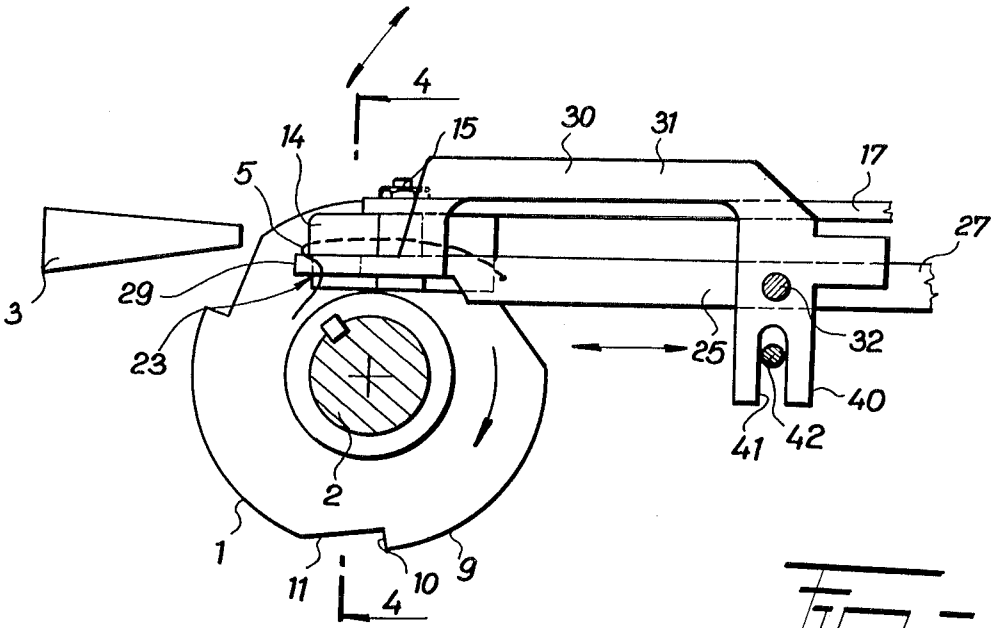
FIG. 3 is a side view of the weft gripping means with closed jaws during the movement of such means from the front to the rear position.
Figure 5:
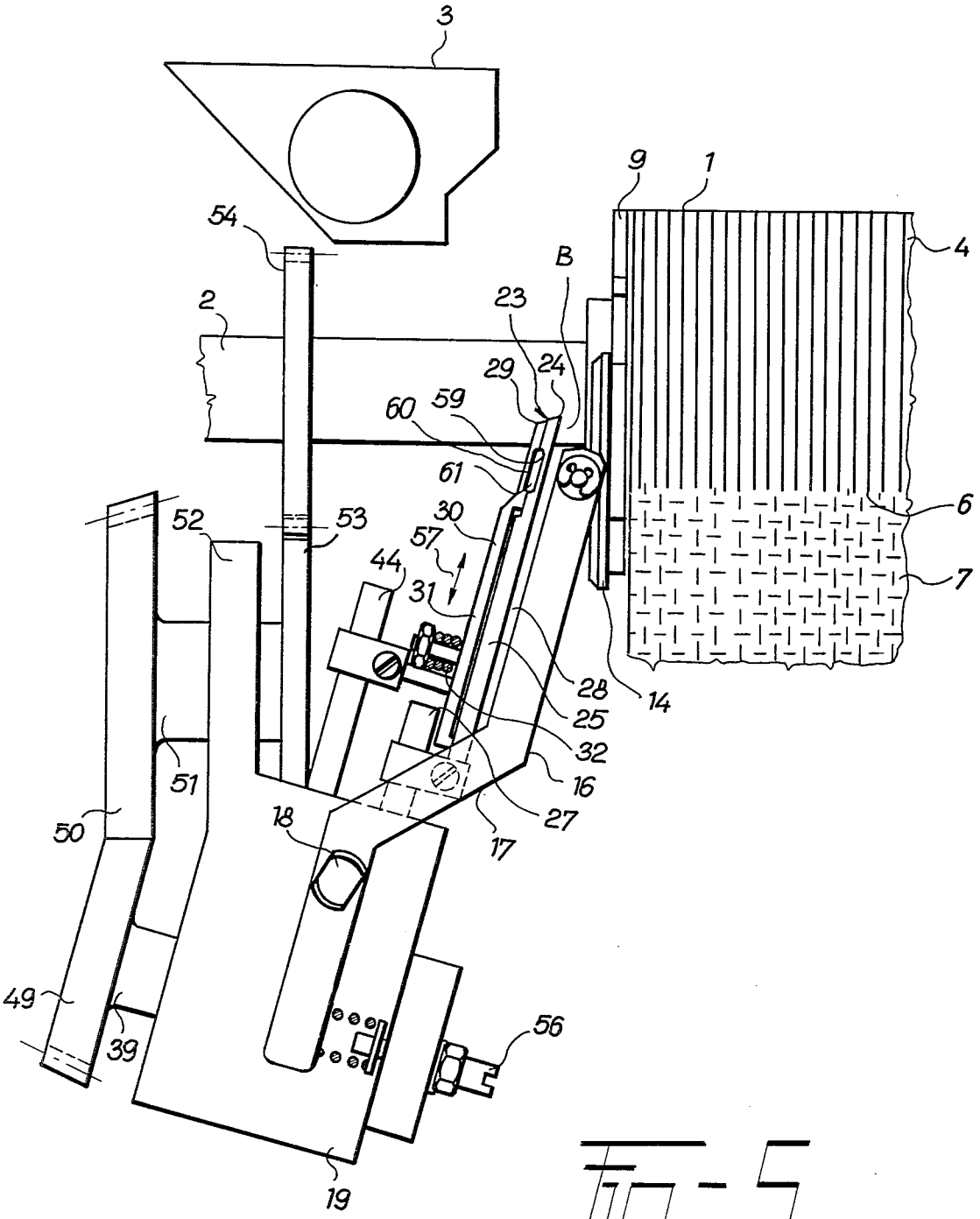
FIG. 5 is an elevation view similar to FIG. 1 but showing the weft gripping mechanism as having moved somewhat forwardly from its rearmost position.
Figure 5:
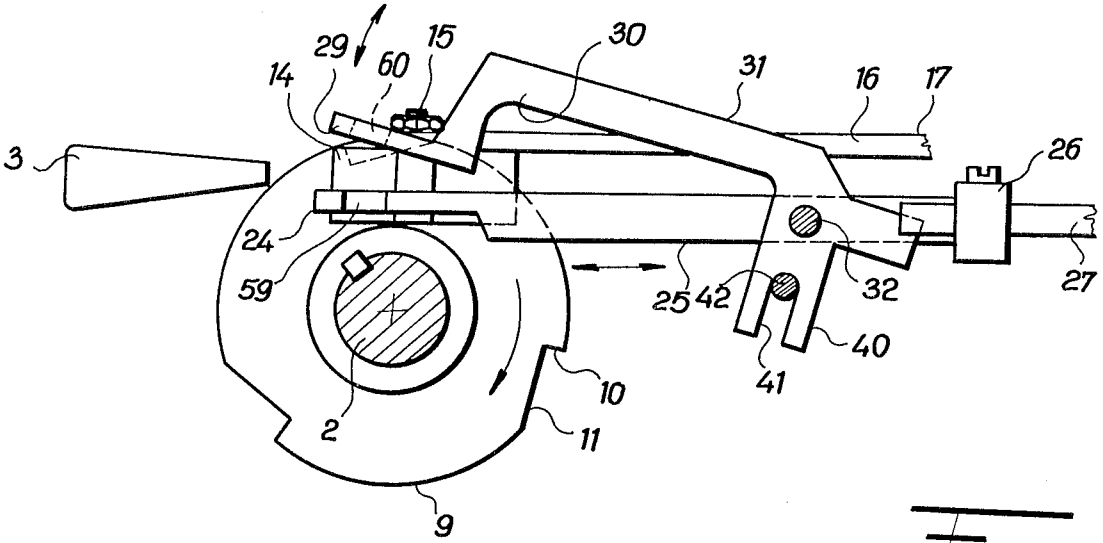

FIGS. 1 and 2 show the gripping means in its foremost position. In FIG. 3 the gripping means is shown with closed jaws and is moving from the foremost to the rearmost position. As above explained, FIG. 5 shows the gripping means as having moved somewhat upstream of its rearmost position. FIG. 6 shows the gripping means with open jaws as moving from its rearmost position to its foremost position, before having seized the weft thread.

Referring now to the drawing, a portion 101 is depicted of a travelling-wave loom of the type which employs a rotary reed 1 for beating up a weft thread 5 into a fell 6 of a fabric 7, such rotary reed consisting of a plurality of beat-up discs 4 disposed in spaced relation along a central axis 102. The reed 1 is fixedly supported on a shaft 2 extending along the axis 102, such shaft being rotatable about such axis by suitable means 103.

Wefts are introduced by weft inserters 3 into travelling sheds following one after the other, said inserters 3 being conveyed one after the other along the rotary reed 1 from its right end to its left end.

A pick length of the weft thread 5 is introduced into a helical groove 22 of the rotary reed by each of the succession of the conventional weft inserters 3 (only one of which is shown) said inserter leaving the groove 22 through a weft-introducing disc 9 which is fixedly supported on the shaft 2 adjacent the end of the reed 1 to the left, in FIG. 1. The disc 9 is provided with a plurality of spaced teeth 10, which are configured to permit movement of the inserters 3 therethrough. The teeth 10 are further adapted to engage the weft thread 5 and, during further rotation of the disc 9 and the reed 1, to help tension the weft end during the beat-up motion of the discs 4. For this purpose, a thrust plate 14 (FIG. 1) is urged against a left-hand surface of the disc 9, with the weft end being movable to between facing surfaces of the thrust plate 14 and the disc 9 as indicated below.

Each of the successive weft inserters 3 is adapted for movement in the direction from right to left in FIG. 1 along an endless path by means of a suitable weft drive 106 in the manner described, e.g., in U.S. Pat. No. 3,862,647. For purposes of the present description, only a portion of the path is shown, such path extending along an axis 104 parallel to the axis 102. Each inserter 3 is moved in a direction to the left as viewed in the drawing along the axis 104 through an aligned one of the teeth 10 in the disc 9. A suitable coupling, represented in the drawing at 107, is provided between the reed and weft drives 103, 106 so that an inserter-admitting flat area of the periphery 11 of the disc 9 is aligned with the path of movement of the inserter 3 during the movement of the latter through the disc 9.

The loom components heretofore described, and the cooperation between them, are all conventional in nature and familiar to those skilled in the art.

The depicted arrangement also includes, in accordance with the invention, a weft gripping mechanism 23 which is adapted to grip the weft 5 carried by the inserter 3 when the inserter 3 has moved past the rear surface of the disc 9.

The gripper 23 functions to maintain the weft end under tension and to move the same rearwardly in synchronism with tooth 10 of disc 9, which tooth draws the weft between the edge of the disc 9 and the plate 14 so as to tension the same during the beat-up operation.

Figure 7:
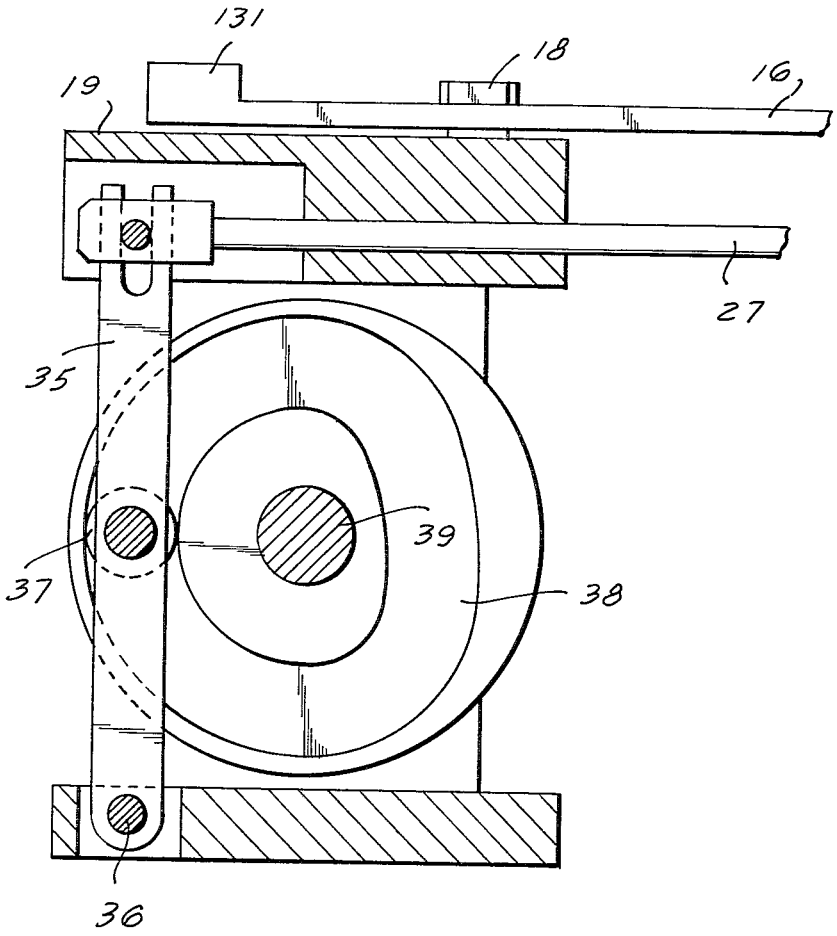
FIG. 7 is a sectional view taken along the line 7—7 in FIG. 2.
Figure 8:
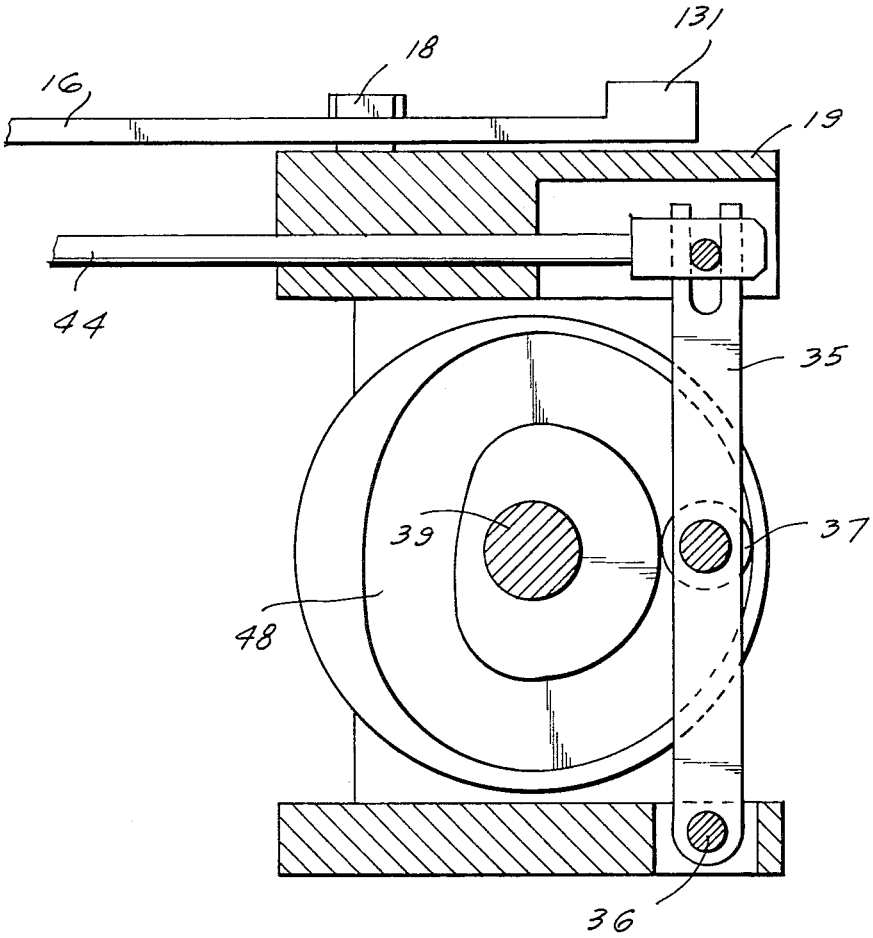
FIG. 8 is a sectional view taken along the line 8—8 in FIG. 2.

The weft-gripping mechanism 23 includes a oxeally movable jaw 24 that is carried on an arm 25, which is movably supported on a rod 27 by means of an adjustable collar 26. As shown in FIGS. 2, 7, and 8, the lower end of the rod 27 is articulated to a lever 35, which is journalled on a pivot 36 carried by a housing 19. Such housing 19 is provided with suitable bearings (not shown) for rotatably supporting a shaft 39. A first cam 38, having a groove 111 therein, is fixedly supported on the shaft 39.

A follower member 37 associated with the lever 35 is positioned in the groove 111 of the cam 38, whereby a rotation of the shaft 39 causes the cam 38 to reciprocate the rod 27 and thus the arm 25 which carries the stationary jaw 24. The above-described components are so chosen that the weft gripping mechanism 23 reciprocates between a forwardmost position, illustrated in FIGS. 1 and 2, and a rearmost position illustrated in FIG. 5 The weft gripping means 23 as shown in FIG. 3 with the jaws 24, 29 closed during the movement of the weft gripping means from the front to the rear position. Throughout the specification the word "front" means the upper end of the apparatus as it is shown in FIG. 1, and the word "rear" means the lower end of the apparatus as it is shown in FIG. 1. The weft gripping means is shown in FIG. 6 with the jaws 24, 29 thereof open during movement of the weft gripping means 23 from the rear to the front position thereof.

The weft gripping mechanism 23, which is axially movable, further includes a pivotally mounted jaw 29, which oscillates with respect to, and is adapted to move into engagement with, the jaw 24. The respective jaws 24 and 29 have mating recesses 59 and 60, which cooperate to form a closed weft-receiving opening 61 (FIG. 1) when the jaws are brought into engaged position.

As best shown in FIG. 3, the jaw 29 forms the extremity of one arm 30 of a two-armed lever 31, such arm 30 being journalled about a pivot pin 32 carried by the arm 25. A spring 33 is secured on the pivot pin 32 by a lock nut 34.

A second arm 40 of the lever 31 is provided at its end with a slotted link 41, which is engaged by a pin 42 affixed to a collar 43 that may be adjustably positioned on a rod 44.

The lower end of the rod 44 is coupled to a lever 46, which is journalled about the pivot 36 in the housing 19. A second cam 48 is affixed to the shaft 39, and has a groove 121 which receives a follower member 47 associated with the lever 46.

In the foremost position, the jaw 24 is disposed to engage the weft carried by the inserter 3 immediately after the inserter moves past the rear surface of the disc 9 as shown. The portion of the weft so engaged extends between the inserter 3 and the tooth 10 of the disc 9. The weft extends between the carrier 3 and reed 1 and through the tooth 10 of the disc 9. The path of reciprocation of the jaw 24, which extends along an axis 112 oblique to the axes 102 and 104, is effective to position a portion of the weft thread 5 (FIG. 1) gripped by the mechanism 23 as described below into the gap between the thrust plate 14 and the disc 9.

With this arrangement, rotation of the shaft 39, in addition to reciprocating the cooperating jaws 24, 29 via the cam 38, will also serve via the cam 48 to oscillate the jaw 29 with respect to the jaw 24 between the engaged position depicted in FIG. 3 and the open position depicted in FIG. 6.

The cams 38 and 48 are suitably offset angularly so that (1) the jaws 24 and 29 are open during a forward movement of the mechanism 23 from its rearmost position to its frontmost position, whereby at the latter position the jaws engage the weft carried by the inserter 3 as shown in FIG. 1, after which the jaws close to grip the weft, and (2) the jaws are thereafter maintained in the closed position during the movement of the mechanism 23 rearwardly from such frontmost position until the gripped weft has been introduced between the thrust plate 14 and the disc 9 and has been secured by them.

A suitable dynamic coupling is provided between the rotatable shaft 39 in the housing 19 and the rotatable reed shaft 2. Such coupling includes a bevel gear pair 49, 50, whose individual gears are respectively carried by the shaft 39 and an auxiliary shaft 51 which is journalled for rotation in a lug 52 integral with the housing 19. The end of the shaft 51 remote from the bevel gear 50 carries a spur gear 53, which engages a spur gear 54 on the shaft 2. Since the rotation of the shaft 2 is further dynamically coupled, via link 107, with the drive 106 of the weft inserter 3, the operative movements of the mechanism 23 are also in timed relation to the movement of the weft inserter 3.

In particular, such dynamic coupling arrangements are so arranged that the jaws 24, 29 move into their forwardmost position to engage the weft thread 5 immediately after the inserter 3 has moved past the rear surface of the disc 9, so that at the instant shown in FIG. 1 the inserter 3 is immediately rearward of the jaws 24, 29. Since such positioning of the mechanism 23 permits the jaws 24, 29 to close and grip the weft thread before the inserter 3 has moved appreciably further along its path and released the weft end, and since in the next rearward movement of the mechanism 23 the gripped weft removed from the inserter 3 is moved into tensioning position between the thrust plate 14 and the disc 9 while the inserter 3 continues to move along its path as shown in FIG. 5, the problem of waste weft length, which would later have to be cut off the fabric selvedge after the beat-up operation, is avoided.

Because of its dimensions the heretofore known apparatus designed for the same purpose has required a larger distance between the weft inserter and the rotary reed after the former has left the shed to seize the weft thread end and to convey it to the fabric fell; in this way a longer unwoven waste weft end portion has arisen.

According to the present invention, the jaws are narrow, allowing their engagement with the weft thread in close proximity to the weft inserter and the rotary reed, whereby the weft end portion which becomes waste is substantially shortened, at the fabric selvage, the weft end portions are interlaced to form a double leno weave which is slit in the middle, the outer half with floating weft end portions being withdrawn to waste.

In order to adjustably force the thrust plate 14 against the disc 9, such plate 14 is journalled about a pivot 15, such pivot being carried on the upper end of a first arm 16 of a two-armed lever 17, such lever being fulcrumed on a pivot 18 affixed to the housing 19. A second or shorter arm of the lever 17 is provided with a projection or dent 131 which bears on a spring 55 of a lock screw mechanism 56, which can be adjusted to vary the contact force of the thrust plate 14 on the disc 9.

The number of cycles of reciprocation of the mechanism 23 corresponds to the number of teeth 10 on the disc 9. Since three teeth 10 are shown in FIG. 3, three cycles of reciprocation in such interval are involved.

Figure 4:
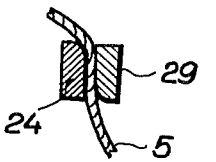
FIG. 4 is a sectional view taken along line 4—4 of FIG. 3.
Figure 9:
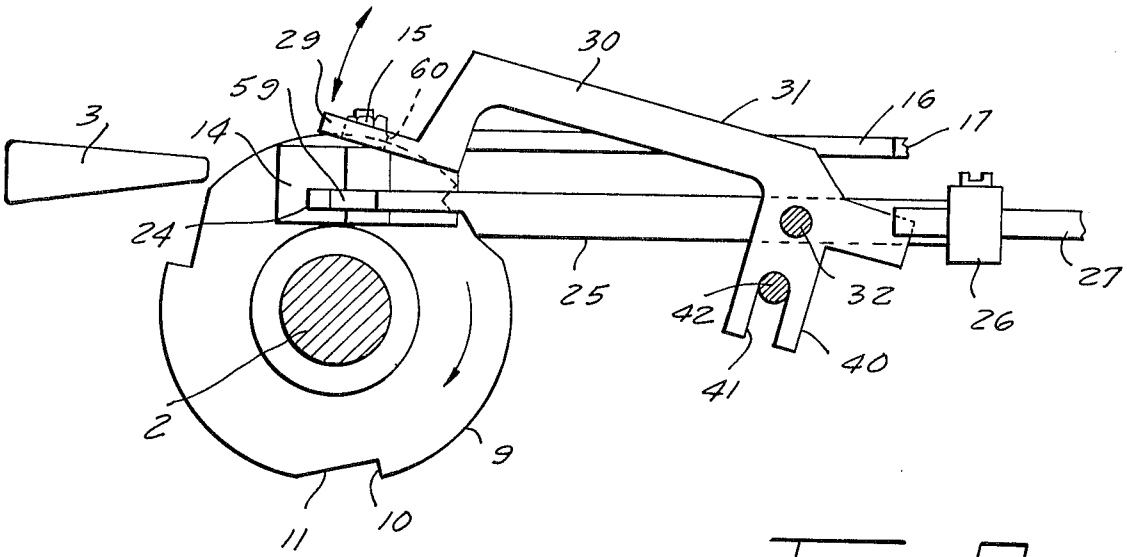
FIG. 9 is a view in side elevation of the weft gripping mechanism as it is shown in its rearmost position in FIG. 5.

In operation, when the inserter 3 moves to the left past the reed 1 and the weft gripping mechanism 23 reaches the forwardmost position shown in FIG. 1, the jaws 24, 29 are operated to engage and close around the weft 5 as seen in FIG. 4, after which the mechanism 23 starts its rearward movement to introduce the gripped weft between thrust plate 14 and disc 9. Thus, further rotation of the disc 9 with the reed 1 during the main beat-up operation will maintain the required tension on the weft. After the weft has been gripped by the jaws 24 and 29 the weft end slips out of the inserter 3. Once the portion of the weft to the right (FIG. 1) of that gripped by the mechanism 23 is engaged in between the plate 14 and the disc 9, the portion of the weft in the mechanism 23 can be released by sliding into the opening 61 between said closed jaws 24 and 29. This takes place as follows: As the weft thread 5 is gripped between the jaws 24, 29, the rotating disc 9 shifts the weft thread after the beat-up thereof to the fabric fell by its dent 10, into the opening 61. At this instant, the weft thread is being re-stretched between the thrust plate 14 and the disc 9. As the mechanism 23 approaches its rearmost position shown in FIGS. 5 and 9, the cam 48 (FIG. 2) opens the jaws 24, 29, and the jaws remain open until the mechanism 23 again moves forwardly to the position shown in FIG. 1.

The length of the weft thread 5 in advance of the weft introducing disc 9, being gripped between said plate 14 and said disc 9 is effectively reduced by the movement of said disc 9 whereby the desired weft tension is established, which tension substantially corresponds to the working tension of the weft withdrawn from the weft inserter 3.

The thrust between the jaws 24 and 29 is adjusted by the lock nut 34 in correspondence with the material type and count of the weft yarn and according to the desired weft tension determined by the braked withdrawal thereof from the weft inserter 3.

The thrust between the thrust plate 14 and the weft introducing disc 9 is controlled by the lock screw mechanism 56 in accordance with the weft thread material.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a travelling-wave loom, a rotary reed having an inner, weft-entering, end and an outer, weft-leaving, end, the rotary reed having a helical groove therein for guiding and beating up a weft thread positioned in cooperative relation thereto as the reed is rotated, means for rotating the reed about a first axis, a weft-introducing disc fixedly supported coaxial with and on the outer end of the reed, the disc having a plurality of spaced teeth on its periphery, a thrust plate supported in contacting relation with the outer surface of the disc and urged thereagainst, the space between the disc and the thrust plate defining a weft-securing space to receive the end of a weft thread leaving the reed for applying tension to the weft thread when the thread is beat-up by the reed, weft insertion means carrying the weft thread and supported for movement in timed relation to the rotation of the reed along an endless path having a portion parallel to the first axis and extending past the reed, elongated weft-gripping means independent of the thrust plate and including a pair of cooperable jaws having confronting weft-gripping portions, the weft-gripping means being supported for reciprocation between a first front position in which the jaws are engageable with the weft thread after the insertion means has moved past the reed and a rear position rearward of the thrust plate whereby a movement of the gripping means from the front position to the rear position when a weft thread is gripped thereby will move the weft thread into the weft-securing space, means for reciprocating the weft-gripping means in timed relation to the movement of the weft-insertion means so that the gripping means reaches its front position substantially immediately after the insertion means has moved past the end of the reed, and jaw-operating means dynamically coupled to the reciprocating means for closing the jaws after the weft-gripping means has reached its front position and for reopening the jaws after the weft is in the weft-securing space.

2. Apparatus as defined in claim 1, in which the gripping means comprises, in combination, an elongated support rod, means for coupling one of the jaws to the support rod, and the other jaw being supported for oscillation toward and away from the first jaw.

3. Apparatus as defined in claim 2, in which the apparatus further comprises a first shaft extending along the first axis for supporting the reed and the disc, and in which the reciprocating means comprises, in combination, a second shaft dynamically coupled to the first shaft, first eccentric means supported on the second shaft, and follower means for coupling the first eccentric means to the support rod.

4. Apparatus as defined in claim 3, in which the jaw-operating means comprises, in combination, second eccentric means affixed to the second shaft in angularly offset relation to the first eccentric means, and second follower means coupled to the second eccentric means for oscillating the second jaw.

5. Apparatus as defined in claim 2, in which the confronting portions of the jaws have alignable recesses which cooperate to form a closed, weft-receiving opening when the jaws are in engagement.

6. Apparatus as defined in claim 2, in which the coupling means comprises, in combination, means for axially adjusting the first jaw on the support rod.

* * * * *